US006770807B1

(12) United States Patent
Myers

(10) Patent No.: US 6,770,807 B1
(45) Date of Patent: Aug. 3, 2004

(54) SOUND PICKUP DEVICE

(76) Inventor: Allen P. Myers, P.O. Box 567, Hampstead, MD (US) 21074

( * ) Notice: Subject to any disclaimer, the term of this patent is extended or adjusted under 35 U.S.C. 154(b) by 0 days.

(21) Appl. No.: 10/403,513

(22) Filed: Apr. 1, 2003

(51) Int. Cl.[7] ..... G10H 3/00
(52) U.S. Cl. ..... 84/723
(58) Field of Search ..... 84/723, 736, 743

(56) References Cited

U.S. PATENT DOCUMENTS

| | | | | | |
|---|---|---|---|---|---|
| 2,293,372 | A | | 8/1942 | Vasilach | |
| 3,073,203 | A | | 1/1963 | Evans | |
| 4,085,646 | A | * | 4/1978 | Naumann | 84/633 |
| 4,182,213 | A | | 1/1980 | Iodice | |
| 4,261,240 | A | | 4/1981 | Aaroe | |
| 4,481,825 | A | | 11/1984 | Kijuev et al. | |
| 4,723,468 | A | * | 2/1988 | Takabayashi et al. | 84/722 |
| 5,033,353 | A | * | 7/1991 | Fala et al. | 84/72 |
| 5,094,137 | A | * | 3/1992 | Matsumoto | 84/615 |
| 5,121,669 | A | * | 6/1992 | Iba et al. | 84/735 |
| 5,206,449 | A | | 4/1993 | McClish | |
| 5,966,090 | A | | 10/1999 | McEwan | |
| 2003/0005816 | A1 | * | 1/2003 | Stuebner et al. | 84/738 |

* cited by examiner

*Primary Examiner*—Jeffrey W Donels
(74) *Attorney, Agent, or Firm*—McGuireWoods LLP

(57) ABSTRACT

The present invention relates to an electronic sound generating system and more particularly to a sound pickup apparatus. By using microwave field, as sound pickup medium, the present invention reduces the noise and hums inherent to the conventional sound pickup device, without sacrificing the sound quality.

21 Claims, 3 Drawing Sheets

SOUND PICKUP DEVICE

BACKGROUND OF THE INVENTION

1. Field of the Invention

The present invention relates to an electronic sound generating system and more particularly to a musical instrument pickup apparatus for a musical instrument, such as a guitar.

2. Discussion of the Related Art

Electronic sound generating systems are utilized in musical instruments for picking up and amplifying the sound of the instrument. The musical instrument may be any type of instrument that produces vibrations. These instruments include microphones, string type instruments, reed type instruments, and the like.

The related art systems generally include transducers for picking up the vibrations of the instrument. The transducers pick up the vibrations and convert them into an electrical signal. Related art transducers include magnetic, piezoelectric, single-coil, humbucking, and infrared types. These systems all have disadvantages and drawbacks which are obviated by the present invention.

The magnetic type pickup systems have been described in U.S. Pat. No. 2,293,372 by S. Vasilach, U.S. Pat. No. 4,182,213 by Iodice, U.S. Pat. No. 4,261,240 by Aaroe and others. Generally, in magnetic pickups, electrical signals are produced in response to the strings traversing the lines of flux from a permanent magnet. However, the magnets in these systems tend to distort the sound of the musical instrument. For example, strings of a musical instrument may be distorted by the magnet causing them to vibrate unnaturally, creating a distorted sound.

Piezoelectric type pickup systems have been described in U.S. Pat. No. 3,073,203 by C. R. Evans, and by others. In these systems the piezoelectric material is typically mounted under the bridge of the guitar preventing the vibrations from being optimally captured. Accordingly, the sound from these systems tends to be flat rather than full-bodied.

Single-coil pickups are well known in the art. The coil pickups are susceptible to electromagnetic interference, thereby degrading the audio quality of the sound. For example, these pickups capture a 60 cycle frequency distortion, or hum, from the surrounding environment. The related art solution to this problem is a humbucking coil pickup.

Humbucking coil pickups generally use coil wound in different directions to cancel the effects of the distortions. That is, part of the coil is wound in a counter-clockwise direction while the other part of the coil is wound in a clockwise direction. The humbucking coil does reduce some of the unwanted distortion. However, the pickup also produces coloration. Coloration involves a loss of high-frequency response and dynamics and has a more boomy and muffled sound. Accordingly, the sounds that can be produced by the instruments are limited and the instruments cannot achieve the sound made from the single-coil type pickups.

Light systems have been described in U.S. Pat. No. 5,206,449 by McClish, and others. These systems operate on the reflectivity of light. Placement of the lights and a light sensitive element is critical in the operation of these systems. Accordingly, the sound produced by these light systems is limited by the location of the system.

Finally, microphone systems are also used as pickups in the related art. The problem with these systems is that they tend to pick up extraneous acoustic noise. Accordingly, the sound of the musical instrument being amplified is distorted.

Additionally, the related art systems are limited by where the pickups can be mounted. For example, the piezoelectric pickup system is mounted under the bridge. Also, the related art systems are typically expensive to manufacture.

Accordingly, there is a need for an inexpensive flexible electronic sound generating system and, more particularly, for a musical instrument pickup apparatus for a stringed musical instrument such as a guitar that obviates one or more of the problems associated with the related art.

SUMMARY OF THE INVENTION

The present invention is directed to an apparatus that substantially obviates one or more of the problems due to limitations and disadvantages of the related art.

The present invention provides an electronic sound generating system and, more particularly, a musical instrument pickup apparatus that provides clear and distortion free sound or distortion reduced sound, thereby providing the best sound quality.

The present invention also provides the pure sound of a single coil pickup without the 60 cycle distortion or hum, without losing the flexibility of the instrument in creation of sound. That is, full-frequency response and dynamics, without any interference from external sources.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages, the present invention employs microwave field as medium to pick up the sound. An oscillator generates and forms microwave field round the sound source, such as a string or a reed. When the instrument is played, the sound source vibrates. The vibration of the sound source changes the frequencies of the electromagnetic field around the sound source. Such changes are detected and output as an electric signal. The present invention enables clear and pure sound pickup and reproduction without coloration or degradation of sound quality.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

An aspect of the present invention relates to an electronic sound generating system and more particularly to a musical instrument pickup apparatus.

The musical instrument may be any kind of instrument that emits a vibration. These instruments may include, for example, string type instruments, reed type instruments, microphones, and the like.

The string type instrument may include, for example, all fretted and non-fretted string instruments with any number strings or string pairs. The reed type instruments include, for example, all reed instruments that use a reed for generating frequencies via vibration. Additionally, microphones have been considered and they generally utilize diaphragms.

The strings of the instrument may be made of any sort of material suitable for generating sound, for example, steel, nylon, and the like or any combination thereof.

Conventionally, sound pick up devices convert vibrations into electrical signals through coils, pressure sensors (e.g., piezo pickup systems), sound wave detection, and/or reflectivity of light (e.g., infrared pickup systems), all of which have a number of disadvantages and drawbacks as discussed above.

Figure 1:
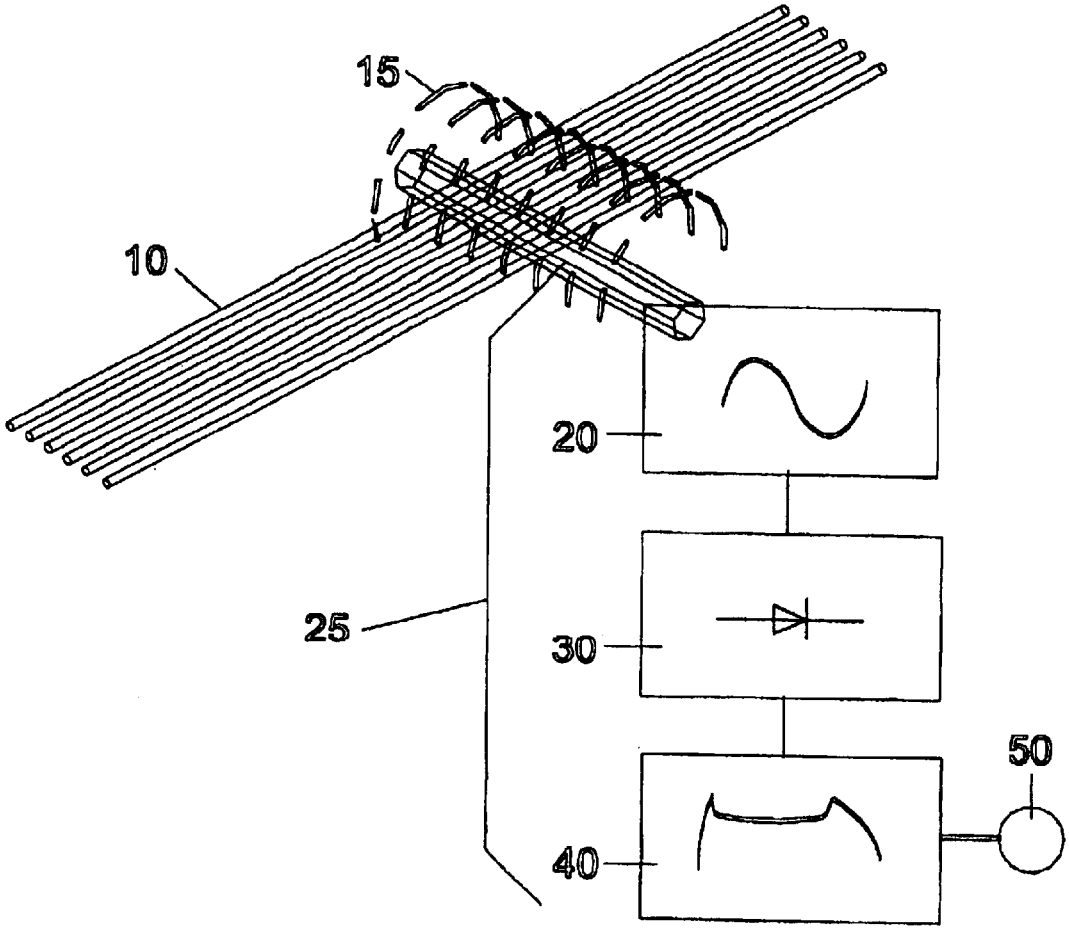
FIG. 1 is a diagram showing the apparatus of the invention associated with a musical instrument.

FIG. 1 is a diagram of a sound pickup device according to an aspect of the present invention.

FIG. 1 discloses an interfering medium (sound source) 10, an oscillator 20, a detector circuit 30. The example of interfering medium 10 is a string and generates a vibration. The oscillator 20 generates electric field 15 around the interfering medium 10. The detector circuit 30 detects the charges of the electric field and generates signals. An audio filter/amplifier 40 files out extraneous inputs and generates an output 50.

The pickup 25 operates on the instability of the oscillator 20. The oscillator 20 contained in the pickup has a natural center frequency. Additionally, the oscillator 20 generates a small electromagnetic field 15. Any interfering medium 10 or movement of an object that passes through or into the electromagnetic field will alter the natural frequency of the oscillator 20. The oscillator 20 is electrically connected to a detector circuit 30. The detector circuit 30 generates an output voltage ($V_{output}$). The $V_{output}$ is directly proportional to the variances of the oscillator center frequency. Accordingly, the output voltage is a direct representation of the audio frequencies generated by the interfering medium 10. Optionally, the output signal is amplified by the amplifier 50 and filtered through the audio filter 40. The audio filter 40 can remove extraneous non-audio frequencies.

The oscillator typically may operate within a frequency range of about 1 GHz to about 80 GHz.

The interfering medium may include any type of vibrating medium. For example, strings, reeds, diaphragms, and the like.

Figure 2:
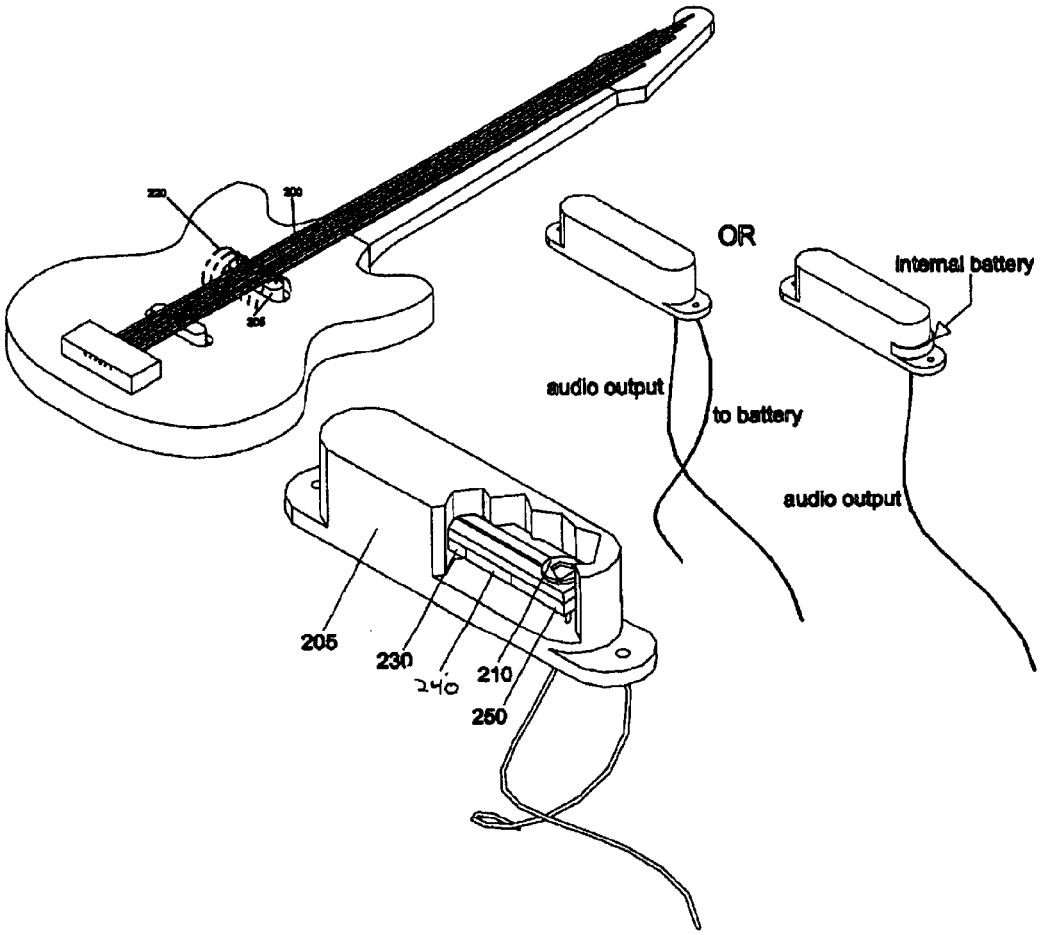
FIG. 2 is a diagram showing the apparatus of the invention according to another aspect of the invention associated with a guitar as the musical instrument.

FIG. 2 is a diagram showing the apparatus according to another aspect of the invention associated with a guitar as the musical instrument.

FIG. 2 discloses a free-running microwave oscillator 210 that is arranged within the guitar pickup 205. The oscillator may operate in a frequency range of about 1 GHz to about 80 GHz. For example, it may operate at a frequency of 2 GHz. These ranges are only exemplary and are intended to be non-limiting. For example, it is contemplated that there is theoretically no limit on the frequency range. Additionally, the oscillator 210 is operating at its natural oscillation frequency.

Guitar strings 200 are the interfering medium and the strings 200 are arranged within the electromagnetic field 220 generated by the oscillator 210. As the strings vibrate, they modulate the center frequency of the oscillator 210 at about the same frequency as the strings 210 are vibrating.

The oscillator 210 is in communication with a detector circuit 230. The detector circuit 30 creates an output voltage ($V_{output}$) that is directly proportional to the variances of the oscillator center frequency. The output voltage ($V_{output}$) signal is electrically sent to an audio filter 240. The audio filter 240 removes any non-audio frequencies from the output voltage signal that may be caused by hand and/or body movement. Finally, the filtered output signal is amplified with an amplifier 250. Optionally, the output voltage signal is not filtered or numerously filtered.

Figure 3:
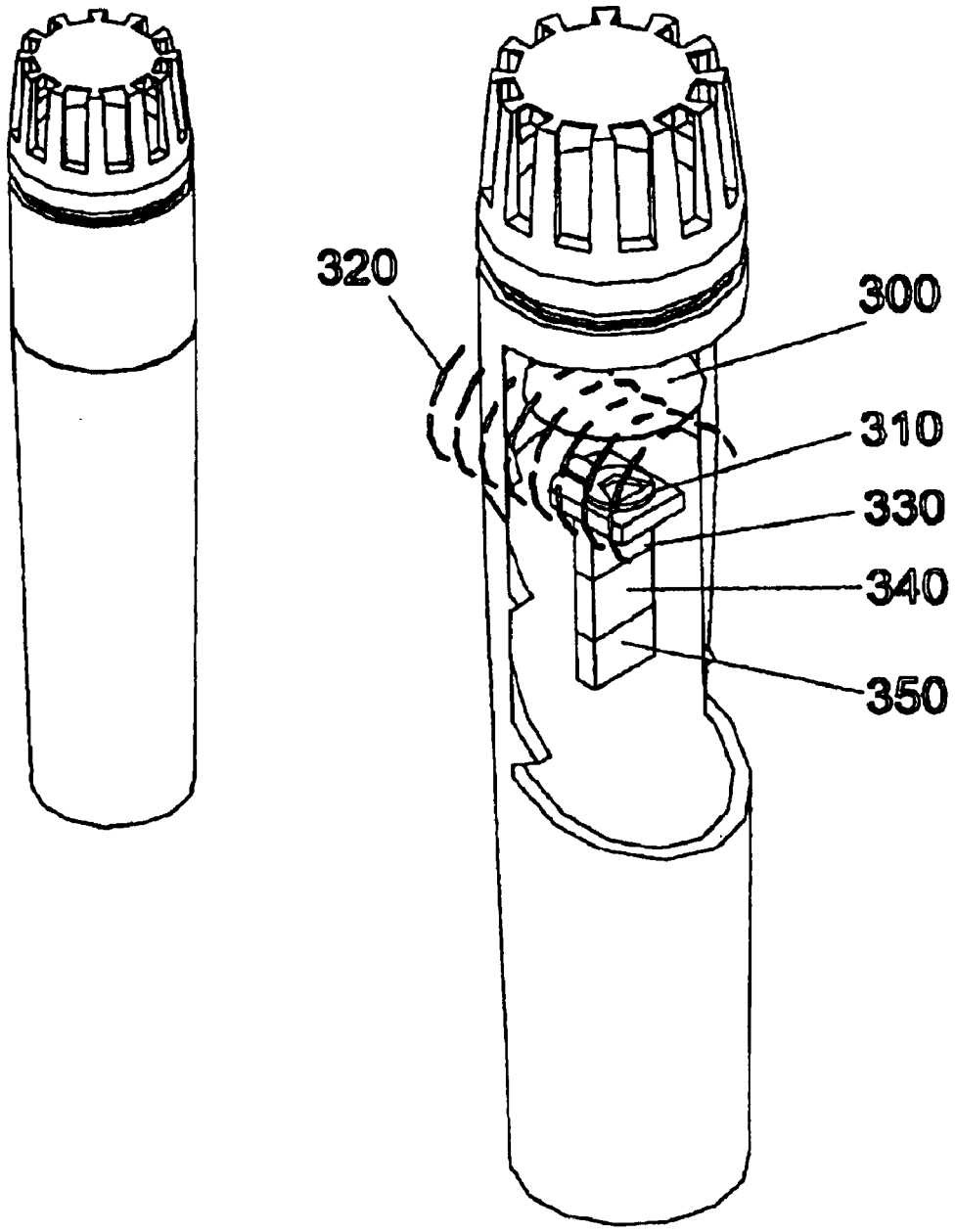
FIG. 3 is a diagram showing the apparatus according to another aspect of the invention associated with a microphone as the musical instrument.

FIG. 3 is a diagram showing the apparatus according to another aspect of the invention associated with a microphone as the musical instrument.

Referring to FIG. 3, a diaphragm 300 is the interfering medium and the diaphragm is arranged within the electromagnetic field 320. The oscillator 310 generates the electromagnetic field 320. As the diaphragm vibrates, it modulates the center frequency of the oscillator 310 at about the same frequency of the diaphragm 300. The diaphragm may be constructed of any suitable material, for example, a thin metal sheet.

The oscillator 310 is in electrical communication with a detector circuit 330. The detector circuit 330 creates an output voltage ($V_{output}$) that is directly proportional to the variances of the oscillator center frequency. The detector circuit can be any type of the kind that may be well known to those skilled in the art, such as a slope detector or a phase-locked loop, however there is no limitation on the detector circuit. The output voltage ($V_{output}$) signal is electrically sent to an audio filter 340. The audio filter 340 removes any non-audio frequencies from the output voltage signal that may be caused by hand and/or body movement or any other sources of electric field. The sources of non-audio frequencies are not limited and may include other electric field, etc. Finally, the filtered output signal is amplified with an amplifier 350. Optionally, the output voltage signal is not filtered or filtered many times.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A sound pickup device, comprising:

an oscillator for generating an electromagnetic field, wherein the electromagnetic field is arranged around a sound source;

a detector circuit in communication with the oscillator, wherein the detector circuit detects changes in a center frequency of the oscillator and generates an output signal based on these chances;

an amplifier in communication with the detector circuit; and an audio filter in communication with the detector circuit, wherein the audio filter filters non-audio frequencies from the output signal.

2. The sound pickup device of claim 1, wherein the amplifier amplifies the output signal.

3. The sound pickup device of claim 1, wherein the sound source is a string.

4. The sound pickup device of claim 3, wherein the string is made of metal.

5. The sound pickup device of claim 3, wherein the string is made of nylon.

6. The sound pickup device of claim 1, wherein the oscillator comprises a free-running microwave.

7. The sound pickup device of claim 1, wherein the oscillator operates at a frequency ranging from about 1 GHz to about 80 GHz.

8. The sound pickup device of claim 7, wherein the oscillator operates at a frequency of about 2 GHz.

9. The sound pickup device of claim 1, wherein the sound source is a reed.

10. The sound pickup device of claim 1, wherein the sound source is a diaphragm.

11. A musical instrument, comprising:

a sound source;

an oscillator for generating an electromagnetic field around the sound source, wherein the oscillator has a center frequency;

a detector circuit in communication with the oscillator, wherein the detector circuit generates an output voltage ($V_{output}$) in response to variances in the center frequency; and an audio filter in communication with the detector circuit.

12. The musical instrument of claim 11, further comprising: an amplifier in communication with the detector circuit.

13. The musical instrument of claim 11, wherein the output signal is a voltage signal corresponding to changes in the electromagnetic field.

14. The musical instrument of claim 13, wherein the voltage signal is proportional to the variances of the oscillator center frequency.

15. The musical instrument of claim 12, wherein the oscillator operates at a frequency ranging from about 1 GHz to about 80 GHz.

16. The musical instrument of claim 15, wherein the oscillator operates at about 2 GHz.

17. The musical instrument of claim 11, wherein the audio filter filters non-audio frequencies from the output signal.

18. The musical instrument of claim 11, wherein the sound source is a string.

19. The musical instrument of claim 11, wherein the sound source is a reed.

20. The musical instrument of claim 11, wherein the sound source is a diaphragm.

21. The musical instrument of claim 16, wherein the musical instrument is a guitar.

* * * * *